252-146 AU 157 EX
2/25/86 XR 4,572,743

United States Patent [19]
Müller et al.

[11] Patent Number: 4,572,743
[45] Date of Patent: Feb. 25, 1986

[54] METHOD FOR PICKLING METALLIC SURFACES

[75] Inventors: Dieter J. Müller; Heinrich Spielbrink, both of Marl, Fed. Rep. of Germany

[73] Assignee: Huels Aktiengesellschaft, Marl, Fed. Rep. of Germany

[21] Appl. No.: 603,273

[22] Filed: Apr. 24, 1984

[30] Foreign Application Priority Data

Apr. 26, 1983 [DE] Fed. Rep. of Germany ..... 3314974
Jul. 9, 1983 [DE] Fed. Rep. of Germany ..... 3324823

[51] Int. Cl.[4] ..... C23G 1/02
[52] U.S. Cl. ..... 134/3; 134/41; 148/6.15 R; 252/146; 252/151
[58] Field of Search ..... 134/3, 41; 148/6.15 R, 148/6.17; 252/143, 146, 151

[56] References Cited

U.S. PATENT DOCUMENTS

| | | | |
|---|---|---|---|
| 3,100,728 | 8/1963 | Vullo et al. | 148/6.15 R |
| 3,197,345 | 7/1965 | Vullo et al. | 148/6.15 R |
| 3,220,890 | 11/1965 | Vullo et al. | 148/6.15 R |
| 3,228,806 | 1/1966 | Fullhart, Jr. et al. | 148/6.15 R |
| 3,277,120 | 10/1966 | Fullhart, Jr. et al. | 260/396 R |
| 3,281,285 | 10/1966 | Campbell | 148/6.17 |
| 3,297,495 | 1/1967 | Vullo et al. | 148/6.17 |
| 3,338,754 | 8/1967 | Vullo et al. | 148/6.15 R |
| 3,438,799 | 4/1969 | Eck et al. | 134/41 |
| 3,778,377 | 12/1973 | Clark | 134/3 |
| 4,008,101 | 2/1977 | Rowe, Jr. et al. | 148/6.15 R |
| 4,029,523 | 6/1977 | Rowe, Jr. et al. | 148/6.17 |
| 4,070,521 | 1/1978 | Rowe, Jr. et al. | 428/332 |
| 4,073,066 | 2/1978 | Rowe, Jr. et al. | 148/6.15 R |
| 4,118,253 | 10/1978 | Rowe, Jr. et al. | 148/6.15 R |
| 4,451,301 | 5/1984 | Mueller | 148/6.15 R |

FOREIGN PATENT DOCUMENTS

| | | | |
|---|---|---|---|
| 1031675 | 5/1978 | Canada | 148/6.17 |
| 0034842 | 1/1984 | European Pat. Off. . | |
| 1293522 | 4/1969 | Fed. Rep. of Germany . | |
| 1236301 | 12/1970 | Fed. Rep. of Germany . | |
| 2611789 | 9/1980 | Fed. Rep. of Germany . | |
| 2611790 | 11/1980 | Fed. Rep. of Germany . | |

OTHER PUBLICATIONS

"Die Phosphatierung von Metallen", von Dr. Werner Rausch Chemische Werke Hols Aktiengesellschaft, E. G. Leuze Publishers, Saulgau (1974) pp. 25–41.

*Primary Examiner*—Peter Hruskoci
*Attorney, Agent, or Firm*—Millen & White

[57] ABSTRACT

A method for removing rust and/or scale from a metal surface, comprising contacting said metal surface with a homogeneous pickling solution comprising a major amount of a halogenated hydrocarbon solvent, an effective solubilizing amount of at least one alcohol solubilizer, an effective pickling amount of an aqueous phosphoric acid and preferably a mixture of phosphoric and sulfuric acids as pickling agent, and an effective inhibiting amount of at least one inhibitor for protecting the bare metal surface; wherein said contacting is effected at a temperature from room temperature up to the boiling point of said pickling solution; and wherein said contacting is continued for a time sufficient to substantially remove said rust and/or scale. This pickling system is advantageously used to prepare metals for phosphating in halocarbon-based phosphating baths.

33 Claims, No Drawings

METHOD FOR PICKLING METALLIC SURFACES

BACKGROUND OF THE INVENTION

The invention relates to a method for removing scale and rust layers, especially on unalloyed steels prior to further treatment by phosphating (phosphatizing) and varnishing, using homogeneous organic pickling solutions based on low-boiling halogentated hydrocarbons as the basic component, containing aqueous phosphoric acid and optionally additionally sulfuric acid as the pickling agents, at least one low-boiling alcohol as the solubilizer, and at least one inhibitor for protection of the bare metal and/or for reduction of hydrogen generation. The pickling solutions of this invention can contain other activating, complex-forming, or reducing compounds.

It is known to free workpieces covered with scale and/or rust from the oxide or hydroxide layers by treatment in aqueous pickling baths in order to obtain completely bare surfaces [W. Rausch, E. G. Leuze Publishers, Saulgau (1974), "Die Phosphatierung von Metallen" (Phosphatizing of Metals), pp. 25–41]. The conventional pickling baths are usually inhibited, aqueous mineral acids, especially hydrochloric, sulfuric, or phosphoric acid [W. Rausch, E. G. Leuze Publishers, Saulgau (1974), "Phosphating of Metals", pp. 25–41]. The process is carried out in a concentration range from about 5 to 20% by weight and, depending on the pickling acid, in a temperature range from 20° to 95° C. A great variety of different classes of compounds can be utilized as inhibitors to prevent attack on the bare metal, such as, for example, aldehydes, amines, nitrites, sulfoxides, thioureas, thiosemicarbazides, and unsaturated alcohols. The pickling periods are normally between 10 and 30 minutes.

After pickling, the resultant salts must be carefully rinsed off with water. The surfaces of the workpieces must not dry off between pickling and phosphating, since drying results in a tendency toward formation of a thin film of rust on the metal surface. Surface rust interferes subsequent phosphating and leads to inadequate corrosion protection. Therefore, the process is usually carried out "wet-in-wet", to ensure satisfactory aqueous phosphating.

German Patent No. 1,236,301 describes homogeneous phosphating baths based on chlorinated hydrocarbons (CHC) with 0.05–7.5% $H_3PO_4$ as the phosphating agent, 0.001–1% of a quinone as the hydrogen acceptor, and 1–10% of a lower alcohol as the solubilizer, obtaining phosphate coatings of about 1–2 g/m$^2$.

According to U.S. Pat. No. 3,338,754, use is made of maximally anhydrous, homogeneous phosphating baths based on CHC with 0.05–6% $H_3PO_4$ as the phosphating agent, 0.001 to 6% inhibitors, such as nitrobenzene, glacial acetic acid, and alkyl thioureas, 0.001–15% stabilizers, such as octyl phenol, diisobutylene, diethyl thiourea, tert-butyl pyrocatechol, and 1–35% solubilizer, such as lower primary alcohols, halogenated alcohols, acetic acid esters, dimethylformamide, and others, obtaining coating weights of about 300 mg/m$^2$ to about 27 g/m$^2$.

DOS No. 1,521,767 describes practically anhydrous, homogeneous phosphating baths based on CHC with 0.1–6% $H_3PO_4$ as the phosphating agent, 0.01–6% of an organic nitro compound or 0.1–0.5% glacial acetic acid, and 1.5–25% of a lower alcohol as the solubilizer, thus obtaining coating weights of between about 270 mg/m$^2$ to above 10 g/m$^2$.

According to DAS No. 2,611,789 and DAS No. 2,611,790, homogeneous phosphating baths based on CHC contain up to 1% $H_3PO_4$ as the phosphating agent, 1–6% $H_2O$, generally up to 25% of a lower alcohol as the solubilizer, and diverse additives of accelerators, stabilizers, and aprotic compounds. Coating weights of about 50 mg/m$^2$ to 3.4 g/m$^2$ can be produced therewith. The phosphoric acid concentration is not to be raised substantially above 1% since otherwise phosphate layers having a tacky feel are obtained.

In European application No. 34 842, aqueous, homogeneous phosphating baths are disclosed based on $CH_2Cl_2$ with up to 2% $H_3PO_4$, with 1–10% $H_2O$, with 10–50% of a lower alcohol, with the addition of small amounts of anionic or amphoteric tensides and accelerators, such as dinitrotoluene, urea or thiourea, producing phosphate layers of varying quality. The more recent phosphating methods based on organic solvents as disclosed, for example, in DAS No. 2,611,789 and DAS No. 2,611,790, EP-A No.34 842, require workpieces that are rust- and scale-free, as well as dry. This prerequisite is obtained in case of greased workpieces without other surface contaminants by simple degreasing, for example with a solvent, in a dipping and/or vapor treatment process.

Under practical conditions, the prerequisite of freedom from rust and scale of the workpieces is frequently unattainable, in spite of corrosion-protective greasing. In these cases, it is necessary not only to degrease the workpiece, but also to remove rust and scale in a suitable way.

Aqueous pickling is unsuitable in such instances, since during the subsequent solvent-based phosphating it is impossible to work "wet-in-wet", and thus surface rust formation and reduction in corrosion protection are unavoidable.

Pickling systems other than aqueous, though, have not been known at all heretofore.

A need therefore exists for a method of pickling and an organic pickling solution to avoid the disadvantages of aqueous pickling systems and to be compatible with organic solvent-based phosphating systems.

OBJECTS OF THE INVENTION

One object of the invention is to provide a non-aqueous pickling system based on organic solvents, which is capable of removing rust and scale, just like an aqueous system, which is adapted for use with organic solvent-based phosphating systems and which does not impair the efficiency of the procedure itself.

Another object of the invention is to provide a pickling system that is adequately inhibited so as to avoid excessive attack on the metal and excessive brittleness of the metal due to hydrogen.

A further object of the invention is to provide a pickling system by use of which it is possible to incorporate into phosphate layers corrosion-inhibiting metals, such as Mn and Zn, without being limited to rust-free surfaces and specific phosphating bath compositions.

Upon further study of the specification and appended claims, further objects and advantages of this invention will become apparent to those skilled in the art.

SUMMARY OF THE INVENTION

These objects have been attained by providing a method for removing rust and/or scale from a metal surface, comprising contacting said metal surface with a homogeneous pickling solution comprising a major amount of a halogenated hydrocarbon solvent, an effective solubilizing amount of at least one alcohol solubilizer, an effective pickling amount of an aqueous phosphoric acid and preferably a mixture of phosphoric and sulfuric acids as pickling agents, and an effective inhibiting amount of at least one inhibitor for protecting the bare metal surface; wherein said contacting is effected at a temperature from room temperature up to the boiling point of said pickling solution; and wherein said contacting is continued for a time sufficient to substantially remove said rust and/or scale.

In a composition of matter aspect, the invention provides pickling solutions suitable for use in the foregoing method.

DETAILED DISCUSSION

The fact that $H_3PO_4$-containing halogenated hydrocarbons—especially chlorinated hydrocarbons (CHC)—can be utilized as pickling solutions in the presence of a solubilizer is especially surprising inasmuch as it has been assumed heretofore that such baths are usable only as phosphating baths with a corresponding phosphate layer formation.

Based on the above-discussed disclosures, it had heretofore been thought that treatment of metallic surfaces with homogeneous mixtures of a chlorinated hydrocarbon as the primary solvent, a lower alcohol as the solubilizer, and aqueous $H_3PO_4$ of varying water content, with the addition of diverse additional components, will always lead to more or less thick phosphate coatings of varying quality.

Since it is the objective of a pickling step to detach only rust and/or scale, whereas the bare metal surface, if at all possible, should not be attacked, and, if at all possible, no layer should be formed on the metallic surface, it could not be expected that mixtures of the aforementioned ingredients, in a suitable composition, can also be employed as pickling baths without appreciable layer formation.

The pickling baths for use in the method of this invention are homogeneous solutions containing the components set forth below. The amounts of the components are expressed in percents by weight.

As the primary solvent, all halogenated hydrocarbons can be used which are also suitable and known for degreasing and phosphating baths, e.g., in particular, chlorinated hydrocarbons and chlorofluorinated hydrocarbons, such as $CH_2Cl_2$, $CHCl_3$, $CHCl{=}CCl_2$, $CCl_2{=}CCl_2$, $CH_3CCl_3$, $C_2H_3Cl_3$, $C_2H_2Cl_4$, $C_2H_4Cl_2$, $C_2H_2Cl_2$, $C_2F_4Cl_2$, $C_2F_3Cl_3$, $CHF_2Cl_3$, $C_2F_2Cl_4$, and $CFCl_3$.

Advantageously, the same solvent used for the degreasing and/or phosphating of the metal surface is also employed for the pickling bath. In other words, if the metal surface is degreased with $CH_2Cl_2$ and phosphated with a phosphating bath based on $CH_2Cl_2$—as described, for example, in DAS No. 2,611,790, EP-A No. 34 842—then it is advantageous to utilize $CH_2Cl_2$ for the pickling bath as well. The amount of halogenated hydrocarbon solvent, e.g., $CH_2Cl_2$, in the pickling solution is between 50 and 85%, preferably between 50 and 75%.

Suitable solubilizers are low-boiling alcohols of 1–4 carbon atoms, such as methanol, ethanol, isopropanol, propanol, butanol, sec-butanol, tert-butanol, their halogenated derivatives, such as chloroethanol, for example and mixtures thereof. Preferred solubilizers are methanol, ethanol, or isopropanol. The solubilizer content is to be selected high enough that a homogeneous pickling solution is obtained. The amount depends on the solubilizer itself as well as on the acid and water contents of the pickling solution. Ordinarily, the content of solubilizer is between 10 and 30%, but it can be as high as about 40%.

The phosphoric acid pickling agent or pickling acid utilized is either phosphoric acid alone or, preferably, a mixture of phosphoric and sulfuric acids. It is also possible to admix other mineral acids, as well as organic acids, preferably formic acid. The total acid content is about 2–10%, preferably about 3–7%. The weight ratio of phosphoric acid to other mineral or organic acid is between about 1:2 and 5:1. Other suitable mineral and organic acids which can be admixed in the phosphoric acid pickling agent include, e.g., hydrochloric acid, acetic acid, chloroacetic acids, oxalic acid.

The pickling baths used in the method of this invention also contain water in order to better keep the salts in solution that have formed during the pickling process. The water content can be smaller as well as larger than the total acid content. Generally, the water content ranges between 1 and 10%, preferably being about 2–6%.

It is not critical, in what manner the water content of the pickling bath is adjusted. Water can be added seperately or preferably in the form of suitably diluted acids. The water content of the pickling solution must be high enough to dissolve completely the pickling acids in the bath, but must not so high that the pickling solution becomes non-homogeneous. The actual water content is not critical within the range of homogeneity.

Another necessary ingredient of the pickling baths used in the method of the invention is at least one component acting as an inhibitor with the function of suppressing an attack of the pickling agent on the bare metal and thus the acid-consuming evolution of hydrogen. Suitable such inhibitors include thiourea and alkylated thioureas. The excellent inhibitor action of this group of compounds in organic pickling baths based on halogenated hydrocarbons is surprising insofar as this group of compounds has been disclosed as having the opposite effect in organic phosphating baths based on halogenated hydrocarbons. Thus, for example, DAS No. 2,611,789, DAS No. 2,611,790, and EP-A No. 34 842 describe urea and thiourea as accelerators to increase the velocity of formation of a phosphate coating. Furthermore, for example, alkylated thioureas are also described as stabilizers for organic phosphating solutions and as enhancing compounds for the formation of the phosphate layer in U.S. Pat. No. 3,281,285; U.S. Pat. No. 3,220,890; U.S. Pat. No. 3,297,495; and in DAS No. 1,293,522. It is thus completely surprising that this class of compounds in the pickling baths of this invention inhibits attack on the metal and thus phosphate layer formation. Generally, all conventional alkylated thioureas can be used. Especially effective are N,N'-ethylene thiourea, diethyl thiourea, and N-hydroxyethyl-N'-allyl thiourea. This group of compounds is normally employed in a concentration of about 0.001–0.2%, preferably 0.01–0.1%. Protection values of above 80% are attained with these inhibitors, the protection value S being defined according to DIN No. 50 940 as $$S = \frac{U - V}{U} \times 100$$

wherein

U = weight loss of a rust-free workpiece in the pickling bath without inhibitor, and V = weight loss of a rust-free workpiece in the pickling bath with inhibitor.

However, other groups of compounds are also suitable as inhibitors. Thus, also effective are unsaturated alcohols, such as, for example, allyl alcohol, methallyl alcohol, preferably butynediol, or aldehydes, such as, for example, acetaldehyde, glyoxal, glycol aldehyde, preferably formaldehyde, although in this case higher amounts are normally utilized, from about 0.1 to about 1%.

Mixtures of one or more of the foregoing inhibitors can also be used, and synergistic improvements of the inhibitor effect can result. For example, with butynediol or formaldehyde alone in the concentration range from 0.2 up to 1.0% protection values of 60 to 70% are attainable whereas by combination of these inhibitors protection values of 80 to 90% are attainable.

Besides the aforementioned primary components of the pickling baths of this invention, these baths can contain further additives having a favorable effect on the pickling action, the necessary pickling time, and the subsequent phosphating process.

Thus, the pickling action is enhanced by adding polar aprotic compounds, e.g., carboxylic acid esters, preferably methyl formate. The amounts added range generally between about 0.3 and about 3% by weight, but they can also be higher. Additionally, the pickling baths of this invention can also contain reducing compounds, such as aldehydes, hydroquinones and the like, and preferably formaldehyde. These reducing compounds are of special advantage if a drying step is effected between pickling and phosphating because they suppress the formation of surface rust. This protective effect is apparent at concentration of as low as about 0.1%; preferably, however, concentrations of between 0.1 and 1% are selected.

Furthermore, soluble zinc, manganese, or calcium compounds can be incorporated in the pickling solution of the invention for the purpose of doping the metallic surfaces, i.e., depositing a thin metal salt film thereon. The concentration of soluble zinc, manganese, or calcium compounds ranges suitably from 0.01% by weight up to the limit of solubility.

Orthophosphates, sulfates, formates, or alcoholates are preferably employed as the soluble zinc, manganese, or calcium compounds.

Similar solutions to those of the pickling solutions according to the invention are known, but these solutions cannot be used as pickling baths because they don't pickle but phosphatize.

Examples of such known solutions are mentioned above in the discussion of prior art.

These known solutions of similar compositions attack the bare metal surface whereas the pickling solutions according to the invention only attack the rusty, but not the bare metal surface.

The pickling solutions of the invention can be used to remove rust and scale and/or to activate rusted as well as rust-free steel surfaces, and optionally to simultaneously produce a thin Zn or Mn salt film on the rust-free surface. The purpose of the latter step is to utilize the metal salt film for doping of a phosphate layer to be subsequently applied and thus to obtain an improvement in the corrosion protection properties of the phosphate layer.

The use of the aforedescribed pickling baths generally takes place in dipping processes, wherein scaled and/or rusted workpieces are dipped into the pickling bath until the layer of scale and/or rust has been removed. Depending on the temperature selected, which can range from room temperature to the boiling temperature of the pickling bath, and also on the degree of rusting, the pickling times are normally between about 5 and 30 minutes. When conducting pickling operations below the boiling point of the pickling bath, it may be advantageous to enhance the amount of matter removed by pickling by a mechanical operation, for example by agitation of the bath or by ultrasound.

Pickling can also be carried out by the spraying method or by a combination of dipping and spraying. The latter is advantageous if especially tenaciously adhering rust is to be removed. It has been found that the oxide layer directly adhering to the metal is detached most easily, and the layers located thereabove drop undissolved into the pickling bath, if pickling is aided by mechanical forces, as is the case during spraying and recirculation of the pickling bath.

In order to attain good phosphating results, i.e., to obtain phosphate layers of high corrosion protection, it may be advantageous to have the pickling step followed directly by a washing step serving for removal of any interfering pickling salts. The washing solutions preferably also contain the components present in the pickling bath, except for the pickling acids. The washing step can be conducted after the dipping as well as after the spraying step, at room temperature up to the boiling point of the washing solution.

It is also possible, according to the invention, to combine a pickling step with a simultaneous doping step, the procedure being such that the desired metals are applied as a thin layer to the metallic surface by dipping or spraying processes with a suitable, metal-containing, corrosion-inhibiting, pickling treatment bath (also called a doping bath) prior to phosphating, the metals being incorporated into the phosphate layer by chemical fixation only during the subsequent phosphating step. According to the invention, non-aqueous pickling baths based on low-boiling halogenated hydrocarbons are utilized as the doping baths, but the latter additionally contain the desired conventional corrosion-inhibiting metals (Zn, Mn, and the like) in the form of dissolved compounds. In this way, rusted as well as rust-free surfaces can be simultaneously pickled and/or activated in either a dipping process or a spraying process, and coated with a foreign metal salt film after the bath has been dried on the surfaces.

The advantage of using the pickling baths of this invention is that it is now possible to use a phosphating bath based on an organic solvent to phosphatize even scaled and rusted workpieces, which heretofore was not readily attainable. Moreover, these pickling baths can also be utilized as activating baths for bare metal surfaces, since phosphating after pickling yields better results.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. In the following examples, all temperatures are set forth uncorrected in degrees Celsius; unless otherwise indicated, all parts and percentages are by weight.

For conducting the experimental examples, the test workpieces employed were low-carbon, cold-rolled deep-drawn metal sheets St 1405 having the dimensions of 10×20 cm, which were greased as is commercially conventional for the purpose of temporary corrosion protection.

For the pickling tests, the metal sheets were first degreased by the vapor or dipping method in commercial metal degreasing baths and thereafter exposed to several days of outside weathering to induce rusting, resulting in typical rust areas with rust layers from 3 to 10 g/m$^2$. For comparative experiments, the same metal sheets, in rust-free condition, were utilized immediately after degreasing for pickling as well as for direct phosphating. The pickling vessel was a heatable jacketed container which, to avoid evaporation losses of the pickling bath, was equipped at the upper rim with cooling coils and with a lid with a bore for introduction of a dipping device.

The pickling baths selected were typical compositions—as will be explained in greater detail in the examples.

Normally, the metal sheets were subjected, after the pickling treatment, to a phosphating step according to German patent application No. 32 09 828.6 in order to examine the influence exerted by the pickling process on a subsequent phosphating step.

The following examples illustrate the pickling baths of this invention and the use thereof in greater detail.

EXAMPLE 1

A series of steel sheets of the above-described type was exposed, after degreasing, to external weathering in an industrial atmosphere for two days and six days, respectively, resulting in uninterrupted rust layers with weight gains of about 3–6 g/m$^2$. The rust-attacked sheets, after having been stored for several days in normal inside air, were subjected to a pickling process by the dipping method in a pickling bath boiling at 38° C. and having the following composition: 70% $CH_2Cl_2$, 23% $CH_3OH$, 3.0% $H_2O$, 0.5% methyl formate, 2.5% $H_3PO_4$, 1% $H_2SO_4$, and 0.03% N,N'-ethylene thiourea.

The protection degree of the pickling bath, determined by preliminary test, was 91%.

After a pickling time of 20 minutes, the sheets were rust-free and bare, without the formation of a visible phosphate layer. The sheets were phosphated after a directly following washing step in a washing bath consisting of the components of the pickling bath without addition of acid and inhibitor.

For comparison purposes, metal sheets not attacked by rust were subjected to pickling and phosphating, and furthermore rust-attacked as well as rust-free sheets were subjected to phosphating without pickling. The resultant weight increases due to phosphating with formation of corresponding protective phosphate layers are listed in Table 1. The protective phosphate layers were exposed to a water-solubility test of the following kind: The dried, phosphated sheets were dipped for 10 minutes at room temperature into fully demineralized water, and the weight increase was determined by weighing prior to and after dipping with subsequent drying.

TABLE 1

Weight Increase after Phosphating of Variously Pretreated Steel Sheets St 1405, and Properties of Resultant Phosphate Layers

| | Metal Sheet | | | |
|---|---|---|---|---|
| | Rust-Attacked/ Pickled | Rust-Attacked/ Not Pickled | Rust-Free/ Pickled | Rust-Free/ Not Pickled |
| Weight Increase Only Due to Phosphating (Average Values) mg/m$^2$ | 2,000 | Undefinable Layer Formation on or with Rust Layer | 1,800 | 1,500 |
| Appearance | Uniformly Grey | Brown, Spotty | Uniformly Grey | Uniformly Grey |
| Water Solubility | <5% | Undeterminable | <5% | <5% |

The table shows, first of all, that rust-attacked metal sheets yield a defined phosphate layer coating with uniform appearance only after pickling. Rust-attacked sheets without being pickled cannot be directly phosphated. In addition, it can be seen that pickling leads to a marked increase in the buildup of phosphate layer with an equally low water solubility of the phosphate layer. The fact that even rust-free sheets can be phosphated more advantageously after pickling demonstrates that, even though pickling is not required with rust-free workpieces, it does have a positive effect on phosphating. Consequently, pickling can also be utilized as an activating pretreatment of rust-attacked as well as rust-free steels.

EXAMPLE 2A

Rust-free metal sheets and rust-attacked metal sheets of the type described in Example 1 were pickled by the dipping method until rust-free in a boiling pickling bath having the following composition for 15 minutes: 50% $CH_2Cl_2$, 18% $CHCl_3$, 15% $CH_3OH$, 10% isopropanol, 2.8% $H_2O$, 3% $H_3PO_4$, 1% $H_2SO_4$, 0.2% HCHO, and 0.05% diethyl thiourea.

The degree of protection, determined by preliminary test, was 88%.

The pickled sheets did not have to be washed immediately after pickling, as in Example 1, since the addition of aldehyde effectively prevented air-borne rust formation.

After phosphating in accordance with Example 1, phosphate layer coating weights of 2.5 g/m$^2$ were obtained with the originally rust-attacked sheets, and, on the average, coating weights of 2.0 g/m$^2$ were produced with the originally rust-free sheets. The phosphate layers showed a uniformly grey appearance. Water solubility was below 5%. It has thus again been demonstrated that pickling is necessary with rust-attacked sheets, but pickling is furthermore likewise advantageous with rust-free sheets.

EXAMPLE 2B

In a parallel test, the pickling bath of Example 2A was utilized for rust removal also by the spraying method. By means of a diaphragm pump, the pickling bath was sprayed at 32° C. under an initial pressure of 1.5 bar in a pulsating fashion with recirculation onto the metal sheet. Freedom of rust was attained after 15 minutes. During a subsequent phosphating step, phosphate layer coating weights were obtained of about 2.5 g/m$^2$.

EXAMPLE 3

Rust-attacked metal sheets of the type described in Example 1 were picked until free of rust for 30 minutes by the dipping method in a boiling pickling bath having the following composition: 52.5% 1,1,2-trichlorotrifluoroethane, 40% $CH_3OH$, 4.8% $H_3PO_4$, 0.4% HCOOH, 2.0% $H_2O$, 0.3% HCHO, and 0.01% hydroxyethyl-N'-allyl thiourea.

A degree of protection of 87% was determined by preliminary test.

The metal sheets were phosphated after washing as in Example 1, thus producing a uniform, grey phosphate coating of, on the average, 1,600 mg/m$^2$. The water solubility of the layer was <5%.

EXAMPLE 4A

Rust-attacked sheets of the type described in Example 1 were pickled for 10 minutes until rust-free by the dipping method in a boiling pickling bath having the following composition: 64.5% $CH_2Cl_2$, 22.5% $CH_3OH$, 4.2% $H_2O$, 3% methyl formate, 3.5% $H_3PO_4$, 1.5% $H_2SO_4$, 0.5% butynediol, and 0.3% formaldehyde.

A degree of protection of 85% was determined by preliminary test.

The sheets were phosphated after washing as in Example 1, thus obtaining a uniformly grey phosphate coating of, on the average, 1,900 mg/m$^2$.

EXAMPLE 4B

In a parallel experiment, rust-attacked sheets were also pickled according to the dipping method in a non-boiling pickling bath having the composition described in Example 4A. The sheets were rust-free after 15 minutes with mechanical agitation of the bath.

EXAMPLE 5A

Rust-attacked sheets of the type disclosed in Example 1 were pickled until rust-free for 20 minutes in a boiling pickling bath having the following composition: 58% trichloroethylene, 16% $C_2H_5OH$, 16% $CH_3OH$, 4% $H_3PO_4$, 1% $H_2SO_4$, 4% $H_2O$, 1% methyl formate, and 0.02% N,N'-ethylene thiourea.

A degree of protection of 85% was determined by preliminary test.

The sheets were phosphated after washing as in Example 1, thus obtaining a uniformly grey phosphate coating of, on the average, 1,600 mg/m$^2$.

EXAMPLE 5B

In a parallel experiment, rust-attacked sheets were pickled according to the dipping method also in a non-boiling pickling bath having the composition disclosed in Example 5A. Freedom of rust was obtained after 35 minutes with mechanical agitation of the bath.

EXAMPLE 6

In this example, the special advantages of adding soluble Zn and Mn compounds for doping purposes are illustrated. The essential experimental and comparison examples are compiled in the form of an overview.

The doping bath employed was a pickling bath containing 70% $CH_2Cl_2$, 23% $CH_3OH$, 3.0% $H_2O$, 0.5% methyl formate, 2.5% $H_3PO_4$, 1% $H_2SO_4$, and 0.03% N,N'-ethylene thiourea with addition of 0.1% $ZnSO_4.7H_2O$ or 0.1% $MnSO_4.H_2O$. For comparison purposes, such a pickling bath without additives was also utilized. The tests with the Zn- and Mn-containing pickling baths were conducted with rust-free as well as rust-attacked sheets. The duration of treatment in the boiling pickling or doping baths was uniformly 20 minutes.

Furthermore, a degreased metal sheet without previous pickling was also subjected to an industrially conventional zinc-phosphating step, obtaining a coating weight of 2,500 mg/m$^2$ which is usual for this kind of phosphating.

After the pickling or doping treatment, the sheets were subjected identically to a nonaqueous phosphating step and subsequently all sheets were varnished identically with a commercially available bicomponent enamel by means of the spraying method.

This process was followed by a 1,000-hour salt spray mist test according to DIN No. 53 167 in conjunction with SS DIN No. 50 021 to determine rust undermining, determining at the same time the degree of blistering according to DIN No. 53 209 and edge rusting according to DIN No. 53 230.

The results of this series of tests are compiled in Table 2. The values in parentheses apply to rust-attacked sheets.

TABLE 2

Comparison of Results of Salt Spray Tests on Various Pretreated, Phosphated, and Varnished Test Sheets

| 1 | 2 | 3 | 4 | 5 |
|---|---|---|---|---|
| | Test Sheet Rust-Free<br>Only Pickled<br>Phosphated<br>Varnished | Test Sheet Rust-Free (Rust-Attacked)<br>Zinc-Pickled<br>Phosphated<br>Varnished | Test Sheet Rust-Free (Rust-Attacked)<br>Manganese-Pickled<br>Phosphated<br>Varnished | Test Sheet Rust-Free<br>Zinc-Phosphated<br>Varnished |
| Layer Coating Weight Due Only to Phosphating mg/m$^2$ | 1,800 | 2,100 (2,200) | 2,000 (2,000) | 2,500 |
| Varnish Coat Thickness, μm | 50–60 | 50–60 (50–60) | 50–60 (50–60) | 50–60 |
| Salt Spray Test, 1,000 h | | | | |
| (a) Rust Undermining, mm | 1.5 | <1 (<1) | <1 (<1) | 1.3 |
| (b) Blister Value | m 1/g 3 | m 1/g 1 (ml/gl) | m 1/g 1 (ml/gl) | m 3/g 3 |

TABLE 2-continued

| Comparison of Results of Salt Spray Tests on Various Pretreated, Phosphated, and Varnished Test Sheets | | | | |
|---|---|---|---|---|
| 1 | 2 | 3 | 4 | 5 |
| (c) Edge Rust | KR 1 | KR 0 (KR 1) | KR 0 (KR 1) | KR 1 |

The results of Table 2 show that the pickling zinc and/or manganese doping step, as compared with a pure pickling step, provides marked improvement in the undermining rust value, but also with respect to the blister value and edge rust. In this connection, it made no difference whether the test sheets were rust-free or rust-attacked prior to treatment.

Also as compared with a commercially conventional zinc-phosphating process, a further improvement is obtained regarding undermining rust and, to a striking extent, also in the blister value.

EXAMPLE 7

The procedure of Example 6 was followed, except that 0.1% $Zn(OOCH)_2.2H_2O$ was added to the pickling bath in place of $ZnSO_4.7H_2O$.

The results obtained with rust-free and rust-attacked sheets after pretreatment, phosphating, and varnishing correspond to those in column 3 of Table 2.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A method for removing rust and/or scale from a metal surface, comprising contacting said metal surface with a homogeneous pickling solution comprising water, a major amount of a halogenated hydrocarbon solvent suitable for degreasing and phosphating baths, an amount of at least one alcoholic solubilizer effective to maintain homogeneity of the pickling solution, an effective pickling amount of above 2% by weight based on said pickling solution of a pickling agent selected from phosphoric acid, and mixtures of phosphoric acid and mineral or organic acid, said mixtures having a weight ratio of phosphoric acid to other mineral or organic acid between about 1:2 and 5:1; the water in the solution being sufficient to dissolve the acid but not so much as to provide a separate aqueous phase, and an effective inhibiting amount of at least one inhibitor for protecting the bare metal surface from attack by said pickling agent; wherein said contacting is effected at a temperature from room temperature up to the boiling point of said pickling solution; and wherein said contacting is continued for a time sufficient to substantially remove said rust and/or scale.

2. The method of claim 1, wherein in said pickling solution, said halogenated hydrocarbon is dichloromethane, trichloroethylene, or trichlorotrifluoroethane.

3. The method of claim 1 wherein the amount of said solvent in said pickling solution is about 50–85% by weight.

4. The method of claim 1, wherein in addition to phosphoric acid, said pickling agent further comprises another inorganic or organic acid.

5. The method of claim 1 wherein the total amount of said pickling agent in said pickling solution is about 3–10% by weight.

6. The method of claim 1 wherein the alcohols used as said solubilizers in said pickling solution are low-boiling $C_1$ to $C_4$ alcohols or halogenated derivatives thereof.

7. The method of claim 1, wherein the amount of said solubilizer in said pickling solution is about 10–40% by weight.

8. The method of claim 1, wherein said inhibitor in said pickling solution is at least one substituted thiourea or thiourea.

9. The method of claim 1, wherein said inhibitor in said pickling solution is at least one unsaturated alcohol.

10. The method of claim 1, wherein the amount of said inhibitor in said pickling solution is about 0.001–1% by weight.

11. The method of claim 1, wherein said pickling solution contains water in an amount from about 1 to 10%.

12. The method of claim 1, wherein said pickling solution further comprises about 0.3–3% by weight of at least one polar aprotic compound.

13. The method of claim 1, wherein said pickling solution further comprises about 0.1–1% by weight of an aldehyde.

14. The method of claim 1, wherein said pickling solution further comprises at least one soluble zinc, manganese, or calcium compound for doping the metallic surfaces.

15. The method of claim 14, wherein the total amount of said soluble zinc, manganese and calcium compounds is from 0.01% by weight to the limit of solubility of said compounds.

16. The method of claim 14, wherein the soluble zinc, manganese, or calcium compounds are orthophosphates, sulfates, formates, or alcoholates.

17. The method of claim 1, wherein rust-attacked and/or scaled steels are treated with said pickling solution by at least one of dipping or spraying.

18. A method according to claim 1 wherein said halogenated hydrocarbon solvent is a chlorinated or chlorofluorinated hydrocarbon of one to two carbon atoms.

19. A method according to claim 1, comprising a further step of phosphating the resultant pickled surface with a phosphating bath based on chlorinated hydrocarbons.

20. A method according to claim 19 wherein the same solvent used for the phosphating step is used for the pickling step.

21. The method of claim 19, wherein said pickling solution further comprises at least one soluble zinc, manganese, or calcium compound for doping the metallic surfaces.

22. A process according to claim 19 further comprising an intermediate step of washing the metallic surface after the pickling step and prior to the phosphating step in order to remove any interfering pickling salts prior to the phosphating step.

23. A process according to claim 22 wherein said washing is conducted with a solution containing the components present in the pickling bath except for the pickling acids.

24. A method according to claim 1 wherein said aqueous phosphoric acid pickling agent comprises phosphoric and sulfuric acids in a weight ratio of about 1:2 to about 5:1.

25. A method according to claim 1 wherein the total acid content is about 3–7% by weight.

26. A method according to claim 1 wherein the water content is about 2–6% by weight.

27. A method according to claim 1 wherein said at least one inhibitor comprises a synergistic mixture of butynediol and formaldehyde.

28. A method according to claim 1 wherein said contacting is conducted between about 5 and 30 minutes.

29. A method of treating a rust-free workpiece to activate its surface and improve phosphating, comprising contacting said workpiece with a homogeneous solution comprising water, a major amount of a halogenated hydrocarbon solvent suitable for degreasing and phosphating baths, an amount of at least one alcoholic solubilizer effective to maintain homogeneity of the pickling solution, an effective pickling amount of above 2% by weight based on said pickling solution of a pickling agent selected from phosphoric acid, and mixtures of phosphoric acid and mineral or organic acid, said mixtures having a weight ratio of phosphoric acid to other mineral or organic acid between about 1:2 and 5:1; the water in the solution being sufficient to dissolve the acid but not so much as to provide a separate aqueous phase, and an effective inhibiting amount of at least one inhibitor for protecting the bare metal surface from attack by said pickling agent; wherein said contacting is effected at a temperature from room temperature up to the boiling point of said pickling solution; and wherein said contacting is continued for a time sufficient to activate the surface of the rust-free workpiece so as to result in a heavier pickup of phosphate layer in a subsequent phosphating step compared to phosphating without this step.

30. A method according to claim 29 wherein said halogenated hydrocarbon solvent is a chlorinated or chlorofluorinated hydrocarbon of one to two carbon atoms.

31. A method according to claim 29, comprising a further step of phosphating the resultant pickled surface with a phosphating bath based on chlorinated hydrocarbons.

32. A method according to claim 31 wherein the same solvent used for the phosphating step is used for the pickling step.

33. The method of claim 31, wherein said pickling solution further comprises at least one soluble zinc, manganese, or calcium compound for doping the metallic surfaces.

* * * * *